US005288239A

United States Patent [19]

Johnson

[11] Patent Number: 5,288,239

[45] Date of Patent: Feb. 22, 1994

[54] DEVICE FOR PREVENTING THE THEFT OF ELECTRICAL APPLIANCES

[76] Inventor: Jack L. Johnson, 608 Carr St., Pea Ridge, Ark. 72751

[21] Appl. No.: 975,532

[22] Filed: Nov. 12, 1992

[51] Int. Cl.[5] ..... H01R 13/44

[52] U.S. Cl. ..... 439/134; 439/304; 439/367

[58] Field of Search ..... 439/133, 134, 304, 367, 439/142, 892

[56] References Cited

U.S. PATENT DOCUMENTS

| | | | |
|---|---|---|---|
| 2,733,416 | 1/1956 | Evalt | 439/134 |
| 3,416,123 | 12/1968 | Husebo | 439/134 |
| 3,690,130 | 9/1972 | Eutzler . | |
| 3,985,183 | 10/1976 | Fernbaugh . | |
| 4,060,297 | 11/1977 | Marshall et al. . | |
| 4,204,723 | 5/1980 | Bloomingdale | 439/134 |
| 4,212,175 | 7/1980 | Zakow . | |
| 4,566,297 | 1/1986 | Hawley | 439/134 |
| 4,705,335 | 11/1987 | Goebel | 439/142 |
| 5,055,057 | 10/1991 | Boyer . | |

*Primary Examiner*—Paula A. Bradley

*Attorney, Agent, or Firm*—Young & Thompson

[57] ABSTRACT

A device for preventing the unauthorized removal of electrical appliances having a cord terminating in a plug with two prongs having aligned holes therethrough, comprises an enclosure adapted to be opened and closed and having holes through a side wall thereof of a size to permit the insertion of the prongs through the holes but to prevent insertion of the plug through the holes. The enclosure is locked against unauthorized opening. A spring clip within the enclosure is removably engageable within the holes through the prongs and releasably retains the prongs within the enclosure. The enclosure comprises two portions hingedly interconnected, and the lock releasably retains these two portions closed together. The enclosure comprises polygonal channels which, when closed together, form a polygonal enclosure of closed polygonal cross-sectional configuration, preferably rectangular, for example square.

14 Claims, 2 Drawing Sheets

FIG. 3
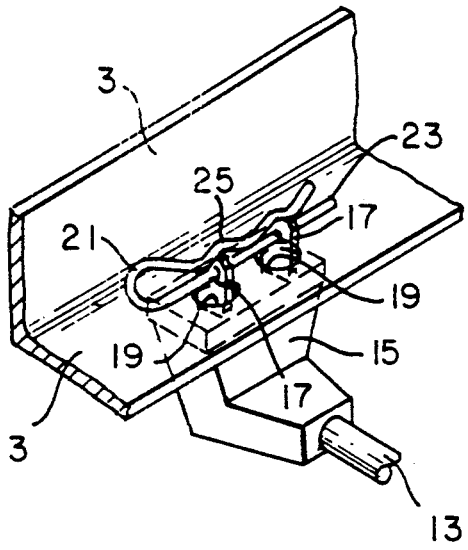
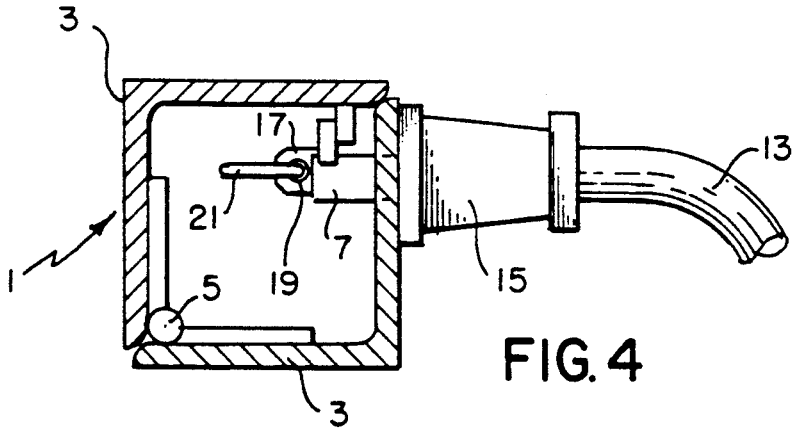
FIG. 4
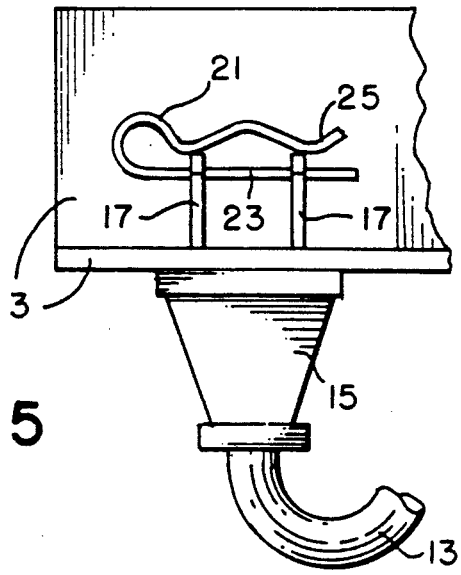
FIG. 5

DEVICE FOR PREVENTING THE THEFT OF ELECTRICAL APPLIANCES

FIELD OF THE INVENTION

The present invention relates to a device for preventing the theft of electrical appliances such as power tools. However, the device of the present invention is applicable to prevention of theft of all small portable electrical devices adapted to be connected to a source of electrical power by an electrical cord terminating in a plug that is plugged into a socket to permit the completion of an electrical circuit through the appliance.

BACKGROUND OF THE INVENTION

The theft of electrical appliances such as power tools, from stores selling the same, is a serious problem costing such stores large sums of money. As the profit margin on power tools tends to be quite small, even a small percentage of theft can wipe out the profit that would otherwise be enjoyed by the store.

Various attempts have been made in the past to curb such theft. One such attempt involves the provision of electronic alarms associated with the appliances, which are triggered by unauthorized removal. However, such electronic alarms are quite expensive and so do not provide a satisfactory solution to the problem.

Another technique for preventing theft is to keep the appliances in locked cabinets such as glass cases, or in locked racks, from which they cannot be removed by the customer. However, this impedes the sales of the appliances, because, particularly in the case of power tools, the customers desire to handle the appliance and note its weight and its balance and its grip and its convenience of manipulation, before buying the same. So it is highly counterproductive of sales, thus to isolate the customers from the merchandise.

SUMMARY OF THE INVENTION

The present invention solves the problem of theft of electrical appliances, while leaving the appliances freely accessible to the potential customers, by making use, for what is believed to be the first time ever in the field of theft prevention, of those two aligned holes through the prongs of the plug at the end of a cord of an electrical appliance. Specifically, the present invention provides an anti-theft device for such appliances, comprising a hollow enclosure to which unauthorized access is prevented by a lock, the enclosure having holes therethrough that will receive the prongs of an electrical plug, but not the plug itself, of an electrical appliance. When the enclosure is open, an authorized person can insert the prongs through the holes and then within the enclosure insert a retainer such as a clip through the aligned holes through the prongs. The clip is sufficiently large to prevent retraction of the prongs from the holes. When the enclosure is closed and locked, unauthorized persons such as customers, and more particularly shoplifters, cannot remove the appliance without cutting the cord. If they cut the cord, they make themselves conspicuous and are quite likely to be caught. Moreover, if they cut the cord, then the cord must be replaced before the item can be fenced or sold; and shoplifters who rely on a quick turnover for income do not wish to become involved in the business of appliance repair. So they will shoplift elsewhere.

But upon completion of a legitimate sale, an authorized person such as a sales clerk, with a key to the enclosure, will open the enclosure, whereupon it is a simple matter to pull out the clip and free the appliance intact.

THE KNOWN PRIOR ART

It is known to provide an elongated casing to receive enlarged parts on the ends of flexible connectors by which articles are to be retained against theft. This concept is shown in U.S. Pat. Nos. 3,690,130, 3,985,183 and 4,212,175.

Moreover, in each of these patents, it is suggested to use this technique for securing electrical items against theft.

Such electrical items no doubt would be provided with electrical cords having plugs. But none of the patentees of these three patents used these electrical cords and plugs for securement purposes. Instead, they provided separate chains or cables to pass through a portion of the electrical appliance and be secured at the ends of the flexible connector to the inside of the elongated casing.

The concept of using the holes through the prongs of an electrical plug, to secure something to the plug, is shown in U.S. Pat. Nos. 4,060,297, 4,204,723 and 5,055,057. In the first two of these, the purpose is to prevent children from partially inserting the plug into an electric socket and completing a circuit through their fingers between the partially inserted prongs. In the last of these, the purpose is for preventing use of the appliance.

But there is no concept in these latter three patents, of using any part of the electric plug to prevent theft of the appliance to which it is connected. More particularly, there is no concept, in any of these, of inserting the electric plug into holes provided in an elongated receiver common to a number of appliances, and then inserting a retainer member through the holes in the prongs which are now disposed within the elongated receiver in the form of a lockable container.

BRIEF DESCRIPTION OF THE DRAWINGS

Other objects, features and advantages of the present invention will become apparent from a consideration of the following description, taken in connection with the accompanying drawings, in which:

FIG. 3 is an enlarged fragmentary perspective view, from within the enclosure, of the plug of an electrical appliance secured thereto according to the present invention;

FIG. 4 is an enlarged cross-sectional view of the enclosure closed and locked with an electrical plug secured thereto; and FIG. 5 is a fragmentary plan view on the same scale as FIG. 4, of the interior of the enclosure with a plug secured thereto.

DETAILED DESCRIPTION OF THE INVENTION

Figure 1:
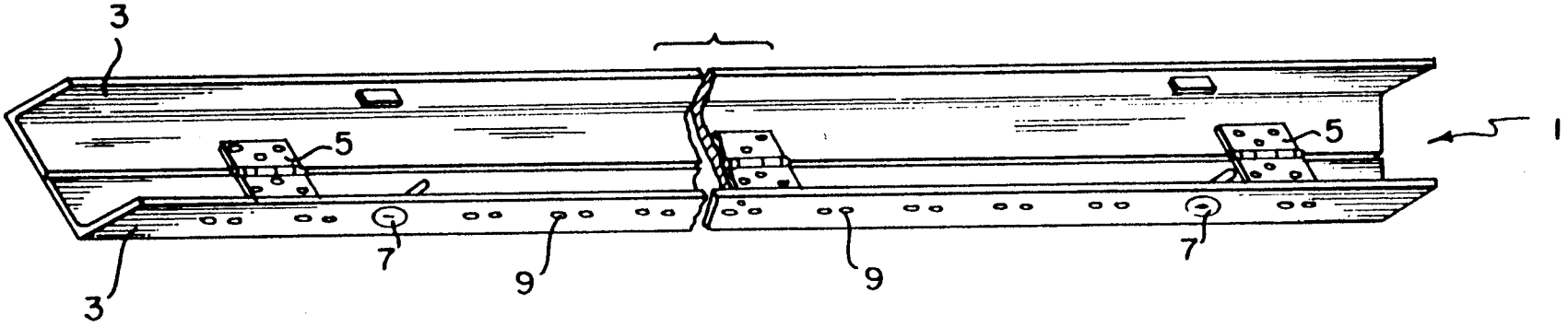
FIG. 1 is a perspective view, with a midportion thereof broken away, of a device according to the present invention in the open position wherein authorized access to its interior is possible.
Figure 2:
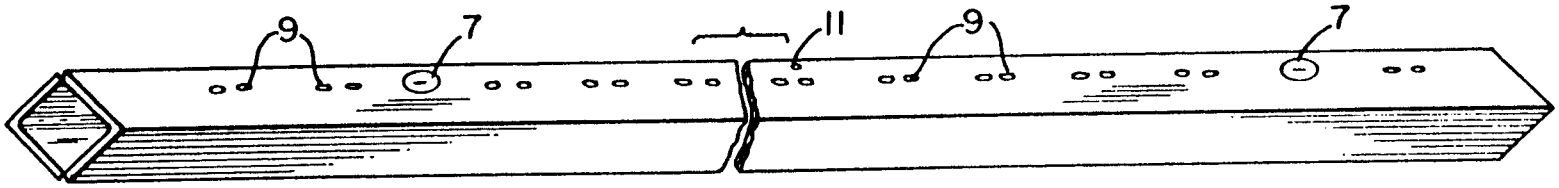
FIG. 2 is a view similar to FIG. 1, but with the enclosure closed.

Referring now the drawings in greater detail, there is shown a hollow enclosure 1 according to the invention, in the form of two channels 3 pivotally interconnected along adjacent longitudinal edges by hinges 5. The channels 3 are preferably of right-angular cross-sectional configuration, and of uniform cross section throughout their length, so that when the channels 3 are swung together as seen in FIG. 2, the hollow enclosure 1 will have a uniform rectangular cross-sectional configuration, e.g. square.

The hollow enclosure 1 thus provided is straight and of indefinite length, its length being determined by the number of electrical appliances that are to be secured thereto by their plugs.

It is intended that the hollow enclosure 1 be fixedly secured to a substrate such as a portion of the sales room that cannot be removed by a shoplifter. However, firm securement of the hollow enclosure 1 to a substrate is not necessary, provided that the hollow enclosure 1 is of sufficient length, and the number of appliances secured thereto sufficiently great, that a shoplifter could not get the assembly out of the store without attracting attention.

As indicated above, access to the interior of hollow enclosure 1 should be restricted to authorized persons, e.g. keyholders such as sales people, managers, etc. For this purpose, hollow enclosure 1 is provided with at least one lock 7 along its length; and in the case of a relatively long enclosure 1, locks 7 can be provided at each end thereof. Each lock 7 comprises a locking member on one of the channels 3 that can be rotated only by insertion of a proper key into the lock, that coacts with a latch on the other channel 3 to permit or prevent relative swinging movement of the channels 3 about the hinges 5.

A multiplicity of holes 9 is provided in spaced relationship lengthwise along one of the sides of hollow enclosure 1. In the illustrated embodiment, two holes 9 are provided for each appliance, one hole for each of the prongs of the plug of the appliance, so that the holes 9 are shown arranged in closely spaced pairs. Of course, other shapes and arrangements of such holes 9 can be envisaged: it is not even necessary that the two holes of a pair be separate: they could merge into one hole, provided only that the hole is not sufficiently large to permit the plug itself to enter the hollow enclosure.

Of course, if the plug is of the grounded type and includes a third or grounding prong, then a third hole 11 can be provided through the same side wall of hollow enclosure 1 as the remaining holes.

An electrical appliance (not shown) to be thus secured against theft, is provided with a cord 13 terminating in a conventional plug 15 which, as previously indicated, has two electrically conductive prongs 17 each with a hole 19 at the end of the prong. The two holes 19 are aligned with each other.

According to the present invention, the prongs 17 of the plug 15 are inserted through the holes 9 of the hollow enclosure 1. With the enclosure 1 open and hence accessible only to an authorized person, a spring clip 21 is inserted through the holes 19 of the prongs 17. The spring clip 21 is of a size which is too large to pass back through the holes 9 and so retains the prongs within the enclosure 1 against unauthorized withdrawal of the prongs and hence against theft of the appliance without cutting the cord 13.

Preferably, the spring clip 21 has two resilient legs comprising a straight leg 23 and a sinuous leg 25. Straight leg 23 is inserted through the two holes and sinuous leg 25 resiliently retains clip 21 in the holes 19 of prongs 17 against accidental dislodgement. But upon a sale of the appliance to a legitimate customer, it is an easy matter to remove spring clip 21 from holes 19 of prongs 17, simply by reversing the movement by which it was inserted.

Thus the operation of the device will be apparent: as many electrical appliances can be attached to hollow enclosure 1 as the length of the enclosure and the number of holes 9 permit. To attach an appliance, it is necessary merely to insert the prongs 17 through the holes 9 and then, with enclosure 1 open, to insert straight leg 23 of spring clip 21 through the aligned holes 19 at the ends of the prongs 17. The enclosure is then closed and locked by manipulation of at least one lock 7.

Upon sale of the appliance, the reverse procedure is followed: an authorized person unlocks the enclosure, opens it, removes the associated spring clip 21, and so can separate the intact appliance from enclosure 1.

It was mentioned above that only the prongs and not the plug extend to the interior of enclosure 1. The reason for this is that the customer does not think he or she is getting a complete appliance, if he or she cannot see the plug at the end of the cord. On the other hand, the attractiveness of the appliance for sales purposes is enhanced by the present invention, because it gives the impression that the appliances are plugged into an electrical outlet and so shows the appliance as it will appear in use. At the same time, however, customers are not disappointed that the appliance does not turn on, because they would not expect that the appliance would be thus plugged into a live outlet where it could be hazardous to children or could be accidentally actuated with damage to persons or property.

So the present invention provides an attractive simulation of an electrical appliance in use, while at the same time preventing theft of the appliance.

It will therefore be recognized that the initially stated aims of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A device for preventing the unauthorized removal of electrical appliances having a cord terminating in a plug with two prongs having aligned holes therethrough, comprising an enclosure comprising two portions hingedly interconnected and adapted to be opened and closed and having holes through a side wall thereof of a size to permit the insertion of said prongs through said holes but to prevent insertion of a said plug through said holes, a lock releasably retaining the enclosure closed against unauthorized opening, and means within the enclosure removably engageable with said holes through said prongs to releasably retain said prongs within said enclosure.

2. A device as claimed in claim 1, wherein said removably engageable means is a spring clip having a leg that passes through said aligned holes through said prongs of said plug.

3. A device as claimed in claim 1, in combination with a plug at the end of a cord of an electrical appliance, said plug having two prongs having said aligned holes therethrough, said prongs extending through said holes through said enclosure and said removable engageable means being engaged in said holes of said prongs within said enclosure.

4. A device as claimed in claim 1, in which said portions comprise polygonal channels which, when closed together, form a polygonal enclosure of closed polygonal cross-sectional configuration.

5. A device as claimed in claim 4, wherein said polygonal enclosure is of rectangular cross section.

6. A device as claimed in claim 5, wherein said rectangular cross section is square.

7. A device for preventing the unauthorized removal of electrical appliances each having a cord terminating in a plug with two prongs having aligned holes therethrough, comprising an elongated enclosure adapted to be opened and closed and having holes through a side wall thereof of a size to permit the insertion of said prongs through said holes but to prevent insertion of a said plug through said holes, said holes through said side wall of said elongated enclosure being disposed in spaced pairs lengthwise of one wall of said elongated enclosure, thereby to permit the insertion of the prongs of the plugs of a plurality of electrical appliances through each of a plurality of pairs of said side wall holes, thereby to permit the protection of a plurality of electrical appliances against unauthorized removal, means releasably to retain the enclosure closed against unauthorized opening, and means within the enclosure removably engageable within said aligned holes through said prongs to releasably retain said prongs within said enclosure.

8. A device as claimed in claim 7, wherein said removably engageable means is a spring clip having a leg that passes through said aligned holes through said prongs of a said plug.

9. A device as claimed in claim 7, in combination with a plug at the end of a cord of an electrical appliance, said plug having two prongs having said aligned holes therethrough, said prongs extending through said holes through said enclosure and said removable engageable means being engaged in said holes of said prongs within said enclosure.

10. A device as claimed in claim 7, said means releasably to retain said enclosure closed comprising a lock.

11. A device as claimed in claim 10, said enclosure comprising two portions hingedly interconnected, and said lock releasably retaining said two portions closed together.

12. A device as claimed in claim 11, in which said portions comprise polygonal channels which, when closed together, form a polygonal enclosure of closed polygonal cross-sectional configuration.

13. A device as claimed in claim 12, wherein said polygonal enclosure is of rectangular cross section.

14. A device as claimed in claim 13, wherein said rectangular cross section is square.

* * * * *